United States Patent [19]

Howard et al.

[11] Patent Number: 4,582,207

[45] Date of Patent: Apr. 15, 1986

[54] SAFETY RESERVOIR SNAP ON OVERCAP FOR PARENTERAL DRUG CONTAINER

[75] Inventors: David S. Howard, Evansville, Ind.; Don C. Stark, Fayetteville, N.Y.

[73] Assignee: Bristol-Myers Company, New York, N.Y.

[21] Appl. No.: 719,384

[22] Filed: Apr. 2, 1985

[51] Int. Cl.[4] ..... B65D 47/36

[52] U.S. Cl. ..... 215/247

[58] Field of Search ..... 215/247, 249; 604/415

[56] References Cited

U.S. PATENT DOCUMENTS

| | | | |
|---|---|---|---|
| 1,191,567 | 7/1916 | Clay | 215/321 |
| 1,554,745 | 9/1925 | McMann | 215/321 |
| 1,857,853 | 5/1932 | McMann | 215/321 |
| 2,364,126 | 12/1944 | Cantor et al. | 215/247 |
| 3,061,131 | 10/1962 | Robinson | 215/321 |
| 3,288,320 | 11/1966 | Swanson | 215/321 |
| 3,484,016 | 12/1969 | Turner | 220/281 |
| 3,578,037 | 5/1971 | Flynn | 141/2 |
| 4,089,432 | 5/1978 | Crankshaw et al. | 215/6 |
| 4,133,441 | 1/1979 | Mittleman et al. | 215/247 |
| 4,152,269 | 5/1979 | Babson | 210/516 |
| 4,187,893 | 2/1980 | Bujan | 604/408 |
| 4,194,640 | 3/1980 | Crankshaw et al. | 215/6 |
| 4,226,333 | 10/1980 | Percarpio | 215/247 |
| 4,267,925 | 5/1981 | Crankshaw et al. | 206/524 |
| 4,274,543 | 6/1981 | Braymer et al. | 215/6 |
| 4,362,250 | 12/1982 | Cottingham | 215/247 |
| 4,441,538 | 4/1984 | Larkin et al. | 604/415 |
| 4,465,200 | 8/1984 | Percarpio | 215/247 |

OTHER PUBLICATIONS

Abstract of European Patent Application 123,659A.

Advertisement on ChemoGuard and drawings thereof.

Hoy et al, American Journal of Hospital Pharmacy, 41, pp. 324–326 (2/84).

NIH Publication 83-2621 titled "Recommendations for the Safe Handling of Parenteral Antineoplastic Drugs".

*Primary Examiner*—Donald F. Norton

*Attorney, Agent, or Firm*—Robert H. Uloth; Richard P. Ryan

[57] ABSTRACT

An overcap for an antineoplastic drug container includes a cylindrical airlock with a depth to diameter ratio preferably less than 1:1, elasticity and inner surface construction to provide pressure against the container closure to seal against leakage, a beveled continuous annular locking flange, and an upstanding annular bead defining a target area for hypodermic needle insertion.

2 Claims, 3 Drawing Figures

SAFETY RESERVOIR SNAP ON OVERCAP FOR PARENTERAL DRUG CONTAINER

TECHNICAL FIELD

This invention relates to a device for prevention of aerosoling of parenteral antineoplastic or other potentially hazardous drugs into the environment during reconsitution of the drug in the drug container and withdrawal of it from the container for use.

BACKGROUND OF THE INVENTION

Antineoplastic drugs, i.e. drugs used to prevent growth and spread of tumors and malignant cells, present special safety problems to medical personnel, e.g. hospital and pharmacy personnel. This is because most of the drugs are toxic and because they are potentially carcinogenic to healthy humans and may also cause other adverse reactions, e.g. skin irritation or burns. Thus, exposure to the drugs by pharmacists, nurses, physicians and other personnel involved in handling these drugs must be minimized.

There would normally be opportunity for medical personnel to be exposed to these drugs because of their nature. These drugs are not sold as compositions ready for administration. This is because when they are combined with diluent, the compositions which are formed normally have a shelf life ranging from several hours to a few days. Thus, in the ordinary course, diluent (usually sterile water, saline solution, dextrose solution or dextrose-saline solution) is added just prior to administration. Most of the drugs are sold in solid form although some are available in solid or liquid form. The diluent is added to the solid drugs to dissolve them and provide selected concentration. The diluent is admixed with drug in liquid form to dilute it to selected concentration. This admixing of diluent with antineoplastic drug is referred to herein as reconstitution. The term "reconstitution" has come into use in this milieu because the drug to which diluent is added has often been lyophilized.

Reconstitution is normally carried out as follows: The drug container (i.e. bottle or vial) is obtained about one-third to one-half filled with drug, e.g. lyophilized material. A hypodermic needle associated with a diluent containing hypodermic syringe is pushed through the drug container closure to enter the interior of the container, and the syringe is used to inject diluent into the container. The syringe is then removed. The material in the container is then swirled to provide uniformity. A hypodermic syringe is then reinserted into the container, and the diluted drug is pulled into the syringe, and the needle is withdrawn. The injecting of the diluent causes a pressure buildup in the container. As a result of the pressure buildup, drug may escape from the container, e.g. being forced out by the pressure during the injection of diluent or when the needle is withdrawn, and become aerosoled into the environment. As a result, reconstitution is normally carried out utilizing elaborate protective equipment, e.g. hoods and special gowns, face masks and gloves. Special venting devices are also sometimes used to reduce internal pressure. The hazards of antineoplastic drugs and the elaborate precautions for their reconstitution are described in NIH Publication No. 83-2621 which is titled "Recommendations for the Safe Handling of Antineoplastic Drugs".

The hoods recommended for protection in the NIH publication are Class II laminar flow biological safety cabinets which are relatively expensive. In the some 8,000 treatment centers without this equipment, there is a high risk not only to the personnel directly involved but there is danger of escaping drug being aerosoled into the air circulation system of the entire facility.

Consideration has been given to preventing aerosoling of antineoplastic drug during reconstitution and dispensing by attaching a guard to the drug vial. The embodiment which has been commercially available is made of relatively rigid plastic and is over two inches deep and contains an inwardly extending guide passageway for the hypodermic needle, a relatively deep aerosol trapping chamber and structure for locking the device on a drug container consisting of a plurality of inwardly and upwardly projecting tabs. The structure is complicated and of multipiece construction requiring assembly and its depth dimension increases the risk of overturning the container.

SUMMARY OF THE INVENTION

The invention herein is directed to a very simple cap for application over the closure and finish of a parenteral antineoplastic or other potentially hazardous drug container to prevent outflow of drug to the environment on reconstitution of the drug by injection into the drug container of dileunt with a hypodermic syringe and needle and withdrawal of reconstituted drug into the syringe and withdrawal of the needle from the container.

The overcap includes a cylindrical drug trapping chamber, e.g. airlock or safety reservoir, with a depth to diameter ratio up to 4:1 or more but preferably less than 1:1, elasticity and inner surface construction to provide pressure against the container closure to seal against leakage, a beveled continuous annular locking flange, and an upstanding annular bead defining a target area for hypodermic needle insertion. When applied, the overcap in its preferred embodiment does not substantially increase the height of the drug container and thus does not provide an unwieldly structure with increased potential for overturning. The overcap is readily constructed of natural rubber and/or synthetic elastomer and is readily formed to be of one piece construction in a conventional molding process.

More particularly the overcap comprises (a) a substantially cylindrical top portion having a vertical axis for alignment with the vertical axis of the container, (b) a skirt integral with and depending downwardly from the top portion and having an inner surface substantially conforming to the contour of the outer surface of the closure and adapted to receive and press against said outer surface, (c) a cylindrical chamber inset into the lower surface of the top portion and having a vertical axis aligned with the vertical axis of the top portion and having a depth to diameter ratio preferably of less than 1:1 and having a volume at least sufficient to retain any drug that would normally escape during reconstitution and removal of reconstituted drug, (d) an annular shoulder defined in said top portion by the sidewall of the cylindrical chamber and having a lower surface defined by lower surface of the top portion and conforming to the contour of the top outer portion of the closure and adapted to press against said outer portion, the ratio of the outer diameter of the shoulder to the inner diameter of the shoulder being at least 1.5:1, (e) a single inwardly extending continuous annular locking flange integral with the bottom of the skirt, said flange having an inwardly angled surface to allow the cap to be pushed down over the container closure and an upper surface adapted to engage under the container finish to retain the cap on the container, (f) an upstanding annular bead in the upper surface of said top portion axially aligned with the vertical axis of the top portion and defining a target area for the insertion through the cap of a hypodermic needle, said cap being of a material having an elasticity substantially that of natural rubber so as to allow application over the closure and to provide sufficient pressure by the lower surface of the shoulder against the top outer portion of the closure and by the inner surface of the skirt against the outer surface of the closure to prevent leakage between said cap and said closure or container during reconstitution.

DESCRIPTION OF THE DRAWING

A preferred embodiment is illustrated in the following figures of the drawing in which.

DETAILED DESCRIPTION

Figure 1:
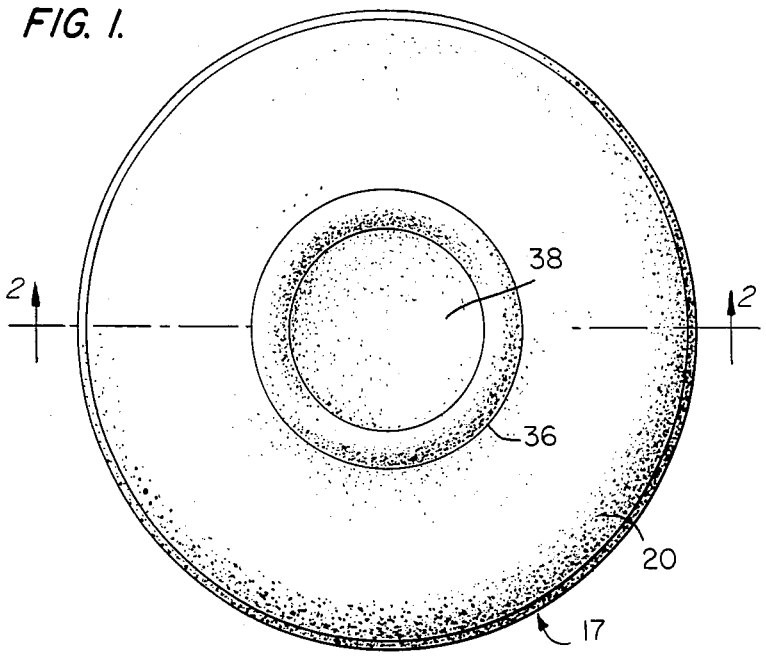
FIG. 1 is a plan view of the overcap herein.
Figure 2:
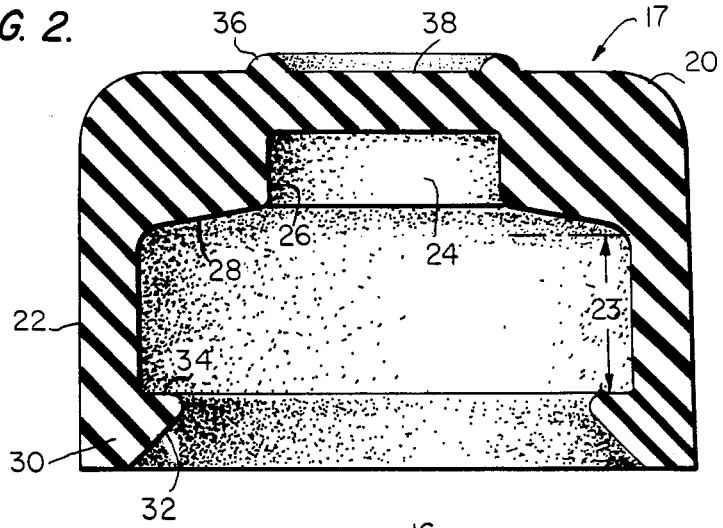
FIG. 2 is a vertical sectional view taken on line 2—2 of FIG. 1.
Figure 3:
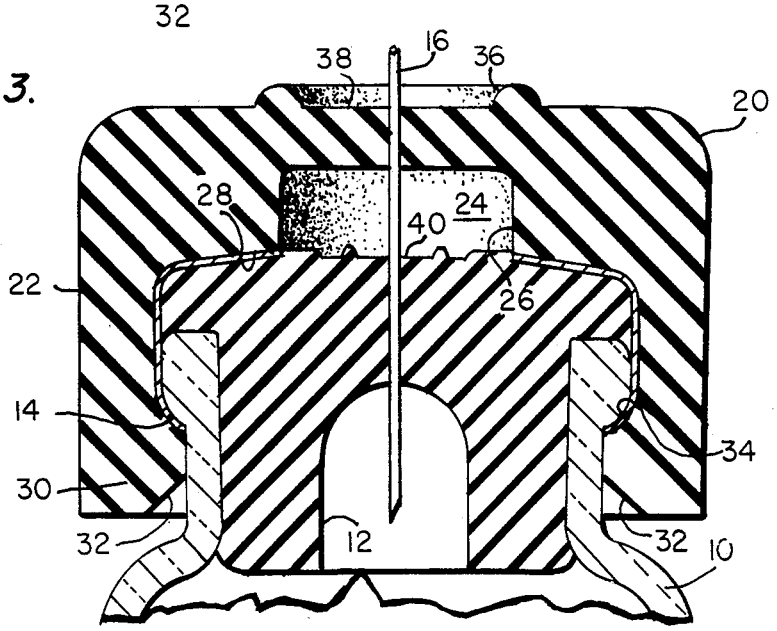
FIG. 3 is a vertical sectional view of an assembly of a drug vial with the overcap of FIGS. 1 and 2 applied thereto.

With continuing reference to FIGS. 1–3, there is depicted in FIG. 3 a drug vial 10 having a closure consisting of a rubber stopper 12 which is held to the vial finish by an aluminum cap 14 having its plastic flip off portion removed to expose the stopper for piercing by needle 16. The aluminum cap 14 presents a substantially cylindrical surface for receiving the overcap of the invention.

The overcap 17 of the invention includes a substantially cylindrical top portion 20 having a vertical axis which as is shown in FIG. 3 is aligned with the vertical axis of the vial when the overcap has been applied.

Integral with the top portion 20 and depending downwardly therefrom is an annular cross section skirt 22 having an inner surface substantially conforming to the contour of the outer surface of the closure and adapted to receive and press against said outer surface. Thus, the inner diameter of the skirt is equal to or slightly less than the outer diameter of aluminum cap 14.

A cylindrical chamber 24 is inset into the lower surface of top portion 20 and has a vertical axis aligned with the vertical axis of top portion 20. It has a depth to diameter ratio preferably ranging from about 0.25:1 to about 0.5:1 and typically has a diameter ranging from about 0.25 inches to about 0.5 inches. The depth to diameter ratio is very important because it allows the top of the overcap to be in proximity with the top of the drug container closure, e.g. 0.15 to 0.4 inches therefrom (not including the vertical dimension of bead 36 discussed later) whereby there is substantially no increased risk of overturning due to the overcap.

An annular shoulder 26 is defined in top portion 20 by the sidewall of cylindrical chamber 24 and has a lower surface 28 (FIG. 2) defined by the lower surface of top portion 20. Shoulder 26 has an inner diameter which is the same as the diameter of chamber 24 and an outer diameter which is the same as the inner diameter of skirt 22 and the ratio of its outer diameter to its inner diameter preferably ranges from about 1.75:1 to about 2.25:1.

An annular locking flange 30 is integral with the bottom of skirt 22 and has an inwardly angled surface 32 providing circular access at the bottom of the overcap with a diameter greater than the outer diameter of aluminum cap 14 and is angled upwardly, e.g. at 40 to 50 degrees, preferably at 45 degrees with the lower surface of the overcap and terminates in a vertical upper inner portion having an inside diameter corresponding approximately to the outside diameter of the neck of vial 10. It has an upper surface 34 which provides a locking lip to engage against aluminum cap 14 at the bottom of the container finish.

The dimension of the surface 28 in the radial direction and the depth dimension of skirt 22, i.e. the vertical distance between the outer margin of suface 28 and lip 34 as denoted by reference numberal 23, are selected to provide sufficient contact surface and the inner diameter and depth of skirt 22 are selected to provide a pinching effect, i.e. a pressing effect against cap 14, to prevent leakage between the overcap 17 and the cap 14.

An upstanding annular bead 36 is part of and in the upper surface of top portion 20 and is axially aligned with the vertical axis of top portion 20. The bead is preferably semicircular in vertical cross section and preferably has a small radial dimension, e.g. 1/64 to 1/16 inch, very preferably 1/32 inch so as not to add materially to the vertical dimension of the overcap. The bead 36 encircles and thereby defines a circular target area 38 for insertion through the overcap of a hypodermic needle. The target area 38 is centered over the cylindrical chamber 24 and on application of the overcap is centered over the target (puncture) area 40 of stopper 12. The vertical dimension of the material of the top portion 20 under target area 38, that is the distance between the top of the top portion 20 at the target area 38 and the top of chamber 24, is sufficiently small, e.g. 0.05–0.2 inches, and the material of construction of the overcap is such that the top portion 20 at target area 38 is readily punctured with a hypodermic needle.

The overcap 17 is preferably constructed of natural rubber as natural rubbber has an elasticity such that with the aforedescribed dimensions, the overcap 17 is readily forced over stopper 12 and aluminum cap 14 by aligning the angled surface 32 over the stopper 12 and cap 14 and pushing downwardly, and such that with the aforedescribed dimensions, the surface 28 and inner surface of skirt 22 (along dimension 23) on application of overcap 17 press against cap 14 and stopper 12 and the finish of vial 10 to prevent leakage between the overcap 17 and cap 14. The overcap 17 can also very appropriately be constructed of synthetic elastomers or a blend of natural rubber with synthetic elastomers but the elasticity should preferably be the same as or close to that of natural rubber. Examples of useful synthetic elastomers include those normally blended with natural rubber, e.g. polybutadiene, polystyrene-butadiene, neoprene and terpolymer elastomer made from ethylene-propylene diene monomer (EPDM).

The overcap herein is readily made of one piece construction in a molding process.

The overcap herein is utilized as follows: The overcap 17 is positioned above the aluminum cap 14 which is in position over stopper 12 and the finish of a vial 10 (e.g. a 30 cc. vial) which contains antineoplastic drug ready for reconstitution (the plastic flip top portion of cap 14 has already been removed to expose stopper 12 so that cap 14 and stopper 12 are as depicted in FIG. 3) and the angled surface 32 is positioned so as to overlie the portion of cap 14 at the edge of the stopper. Then overcap 17 is pushed downwardly so as to fit over the cap 14 and so that locking lip 34 engages cap 14 at a position under the container finish as depicted in FIG. 3. Then a hypodermic needle 16, e.g. an 18 gauge needle, which is associated with a syringe (not depicted), e.g. a 30 cc. B-D disposable syringe having the selected amount of diluent therein (e.g. 20 cc. of diluent) is positioned above target area 38 approximately centrally of target area 38 so as also to be above target area 40, and the needle 16 is forced through overcap 17 and stopper 12 so as to be in position as depicted in FIG. 3. Then the diluent is injected into the vial 10, e.g. in a single push. Despite the internal pressure created by the injection, the overcap 17 does not bulge or pop off. The needle 16 is then removed. The vial 10 is then moved to swirl the liquid injected therein to dissolve the drug. The needle 16 is then reinserted and the syringe is then used to withdraw the reconstituted drug. Then the needle 16 is withdrawn first from stopper 12 and then from overcap 17. As the needle 16 is withdrawn, the stopper 12 and overcap 17 exert a wiping action to wipe residual drug therefrom so that it returns to vial 10 or to chamber 24. To the extent that drug is forced out of vial 10 by the increased pressure due to initial injection of diluent, either during said injection or during dissolving/swirling or during withdrawal of reconstituted drug into the syringe or withdrawal of the needle 16 from the stopper 12 and overcap 17, it is trapped in chamber 24. There is no aerosoling of reconstituted drug into the environment or leakage between aluminum cap 14 and overcap 17. When the overcap is needle punctured a second time and injection is carried out whereby even 1.0 ml. solution more enters chamber 24, there is no leakage out of the first puncture hole.

Testing is carried out on the overcap 17 as follows. The overcap 17, of one piece natural rubber molded construction is applied to a 30 cc. molded flint glass vial 10 with 20 mm. finish with the plastic flip top portion of cap 14 having already been removed. A 30 cc. B-D disposable syringe equipped with an 18 gauge needle 16 and containing 20 cc. of water containing a blue die is positioned with needle 16 above and centrally of target area 38 and is forced through the overcap 17 and stopper 12. Then the blue colored water is injected into vial 10 in a single push without regard for pressure equalization. The needle is removed while a positive pressure remains in vial 10. No visible spray is detected. When the aforedescribed injection is carried out without overcap 17 being used, a visible spray of aerosolized blue colored water is noted on withdrawal of the needle.

In another test, the 18 gauge needle 16 is used to prenetrate the overcap 17 but not the stopper 12. Diluent is injected into the chamber in 0.25 cc. increments with inspection of the overcap equipped vial between injections for leakage at the puncture area and at the seal area between overcap 17 and cap 14. No leakage is observed until the fifth successive injection when leakage is noted in the seal area.

In another test the 18 gauge needle is used to puncture the overcap at the target area 38 wherein the thickness is about 0.1 inch. The needle is then withdrawn. The needle is then inserted again at a second puncture point in target area 38 and water is injected into chamber 24. No leakage is noted out of the first puncture passageway even though up to 1.0 ml. is injected into chamber 24 due to the elasticity and resiliency of the natural rubber material of overcap 17.

While the foregoing describes preferred embodiments, modifications within the scope of the invention will be readily evident to those skilled in the art. Thus the scope of the invention is intended to be defined by the claims.

What is claimed is:

1. Safety reservoir cap for application over the closure and finish of a parenteral drug container to prevent outflow to the environment of said drug upon reconstitution of the drug by injection into the drug container of diluent with a hypodermic syringe and needle and withdrawal of reconstituted drug into the syringe and withdrawal of the needle from the container, said cap comprising:

(a) a substantially cylindrical top portion having a vertical axis for alignment with the vertical axis of the container, (b) a skirt integral with and depending downwardly from the top portion and having an inner surface substantially conforming to the contour of the outer surface of the closure and adapted to receive and press against said outer surface, (c) a cylindrical chamber inset into the lower surface of the top portion and having a vertical axis aligned with the vertical axis of the top portion and having a volume at least sufficient to retain any drug that would normally escape during reconstitution and removal of reconstituted drug, (d) an annular shoulder defined in said top portion by the sidewall of the cylindrical chamber and having a lower surface defined by lower surface of the top portion and conformihg to the contour of the top outer portion of the closure and adapted to press against said outer portion, the ratio of the outer diameter of the shoulder to the inner diameter of the shoulder being at least 1.5:1, (e) a single inwardly extending continuous annular locking flange integral with the bottom of the skirt, said flange having an inwardly angled surface to allow the cap to be pushed down over the container closure and an upper surface adapted to engage under the container finish to retain the cap on the container, (f) an upstanding annular bead in the upper surface of said top portion axially aligned with the vertical axis of the top portion and defining a target area for the insertion through the cap of said needle, said cap being of a material having an elasticity substantially that of natural rubber so as to allow application over the closure and to provide sufficient pressure by the lower surface of the shoulder against the top outer portion of the closure and by the inner surface of th skirt against the outer surface of the closure to prevent leakage between said cap and said closure or container during reconstitution.

2. Safety reservoir cap as recited in claim 1 wherein said cylindrical chamber has a depth to diameter ratio of less than 1:1.

* * * * *